US005593287A

United States Patent [19]

Sadakata et al.

[11] Patent Number: 5,593,287

[45] Date of Patent: Jan. 14, 1997

[54] FUEL FEED PUMP

[75] Inventors: Nobuyasu Sadakata, Isesaki; Bunji Honma, Ohta; Hideyuki Iwamoto, Maebashi; Yoichi Shindo, Kiryu; Akira Yomoda, Tamamuramachi, all of Japan

[73] Assignee: Mitsuba Electric Manufacturing Co., Ltd., Gunma, Japan

[21] Appl. No.: 342,263

[22] Filed: Nov. 18, 1994

[30] Foreign Application Priority Data

Nov. 19, 1993 [JP] Japan ..... 5-314431

[51] Int. Cl.[6] ..... F04B 39/06

[52] U.S. Cl. ..... 417/366; 417/423.14; 417/410.4; 123/509

[58] Field of Search ..... 417/366, 410.4, 417/410.3, 423.3, 423.7, 423.8, 423.11, 423.14; 418/152; 123/495, 509, 41.31

[56] References Cited

U.S. PATENT DOCUMENTS

| | | | |
|---|---|---|---|
| 3,801,231 | 4/1974 | Nusser et al. | 417/410.4 |
| 3,897,179 | 7/1975 | Fussner et al. | 417/366 |
| 5,015,159 | 5/1991 | Mine et al. | 123/41.31 |
| 5,356,272 | 10/1994 | Nagata et al. | 417/366 |
| 5,361,742 | 11/1994 | Briggs et al. | 123/497 |
| 5,454,697 | 10/1995 | Nakanishi | 123/509 |

*Primary Examiner*—Timothy Thorpe
*Assistant Examiner*—Peter G. Korytnyk

[57] ABSTRACT

A fuel pump wherein the inner cylinder 37 for forming the fuel duct 38, in the outer cylinder 14, is provided between the stator 34 and the rotor 32 of the brushless motor 12, one end portion of the inner cylinder 37 is blockaded by the holder plate 41. The contacting pipe 44 for connecting from the fuel duct 38 to the delivery duct 21 is protrudely provided at the holder plate 41, and the control circuit unit 13 of the brushless motor 12 is held thereon. A resin sealed portion 52 is formed between the outer cylinder 14 and the inner cylinder 37, and the circumference of the control circuit unit 13 in the inner cylinder 37 by a potting method. The fuel 54 is lead from the introductory duct 16 to the fuel duct 38 of the inner cylinder 37, and is delivered from the delivery duct 21 through the insides of the fuel duct 38 and the contacting pipe 44. Since the fuel 54 does not contact on the resin sealed portion 52 and the control circuit unit 13, it is possible to prevent electric corrosion, conduction and a short of the resin sealed portion 52 and the control circuit unit 13 by the fuel 54.

19 Claims, 3 Drawing Sheets

FUEL FEED PUMP

BACKGROUND OF THE INVENTION

1. Field of the Invention

This invention relates to a fuel feed pump, more particularly, to a fuel feed pump having a housing into which a pump and a motor for driving the pump are integrated, which is effectively employed, for example in a fuel feed pump for a vehicle.

2. Description of the Related Art

In general, in a fuel feed pump having a housing into which a pump and a motor for driving the pump are integrated, a brushless motor is employed. A control circuit unit for forming a rotation-magnetic field is necessary for a brushless motor; a unit of the control circuit unit is also generally integrated into the housing close to the brushless motor.

However, when the control circuit unit contacts fuel, electric corrosion, conduction and a short occur. Therefore, a fuel feed pump is proposed, in which a control circuit unit of the brushless motor is stored in a sealed casing, and a resin sealed portion is formed by a press-forming method (molding method) on a periphery of the sealed casing storing the control circuit unit, which is thereby constructed so as to prevent the contact with the fuel of the control circuit unit of the brushless motor (laying open of application No. 5-211738).

However, in the prior fuel feed pump hereinbefore, there are problems as follows.

(1) It is necessary to manufacture the sealed casing storing the control circuit unit so as to be able to bear the pressure of a press-forming of the resin sealed portion, so that the manufacturing cost is high. Furthermore, the pressure of a press-forming is restricted by the pressure performance of the sealed casing, so that the forming pressure can not be predetermined to a high pressure.

(2) When press-forming the resin sealed portion, the temperature of the press-forming is restricted by the heat resistance of the elements in the control circuit unit, so that it is difficult to keep the accuracy of the forming. On the other hand, the whole control circuit unit is covered doubly by the sealed casing and the resin sealed portion, so that it is difficult to radiate the exothermicity of the control circuit.

(3) As a forming material of the resin sealed portion, the use of thermosetting resin such as epoxy resin is necessary, so that oil proofing is a problem when using methanol fuel.

SUMMARY OF THE INVENTION

It is an object of the present invention to provide a fuel feed pump which can seal a control circuit unit by a resin sealed portion without storing a sealed casing.

So as to satisfy these objects, the present invention provides a fuel feed pump wherein a housing, a pump in a housing, a brushless motor for driving the pump, a control circuit unit for controlling the brushless motor are assembled, a fuel duct is formed on the inside of the housing, a fuel is lead from a introductory duct which is opened at one end portion of the housing to the fuel duct, and is delivered from a delivery duct which is opened at the other end portion of the housing;

the fuel feed pump comprising:

an inner cylinder, which is provided between a stator and the rotor of the brushless motor, the fuel duct is formed by a space thereof;

a holder plate, which is provided at one end portion of the inner cylinder, which is blockaded thereby and the control circuit unit is held thereon;

a contacting pipe for a constructing duct, which is provided at the holder plate, the fuel duct of the inner cylinder and the delivery duct are connected to each other by the constructing duct;

a resin sealed portion, which is formed in an outside space of the inner cylinder and the circumference of the control circuit unit in the housing by a potting resin.

According to the present invention, fuel is affected by an absorbing operation of the pump, which is lead from the introductory duct to the fuel duct which is formed by the space in the inner cylinder, is therefrom lead to the delivery duct through the fuel duct and the contacting duct of the contacting pipe, and is delivered from the delivery duct to the outside. During this time, the fuel does not touch to the resin sealed portion and the control circuit unit, so that the occurrence of electric corrosion, conduction and a short are prevented.

Furthermore, the control circuit unit is sealed by the resin sealed portion, so that the control circuit unit is in a state to be protected from an external force and vibration. The resin sealed portion is formed by potting resin, so that it is possible to prevent the damage of the control circuit unit by a forming work when potting to the resin sealed portion. On the other hand, it is possible to prevent the restriction of the forming condition of the potting method by the pressure performance, the heat resistance and the like of the control circuit unit.

Furthermore, the control circuit unit is not sealed in a sealed casing, so that the exothermicity of the control circuit unit is radiated far more efficiently as compared with a case in which the whole control circuit unit is covered doubly by the sealed casing and the resin sealed portion.

As described above, according to the present invention, the fuel feed pump can seal a control circuit unit by a resin sealed portion without storing a sealed casing.

DESCRIPTION OF THE PREFERRED EMBODIMENT

Figure 1:
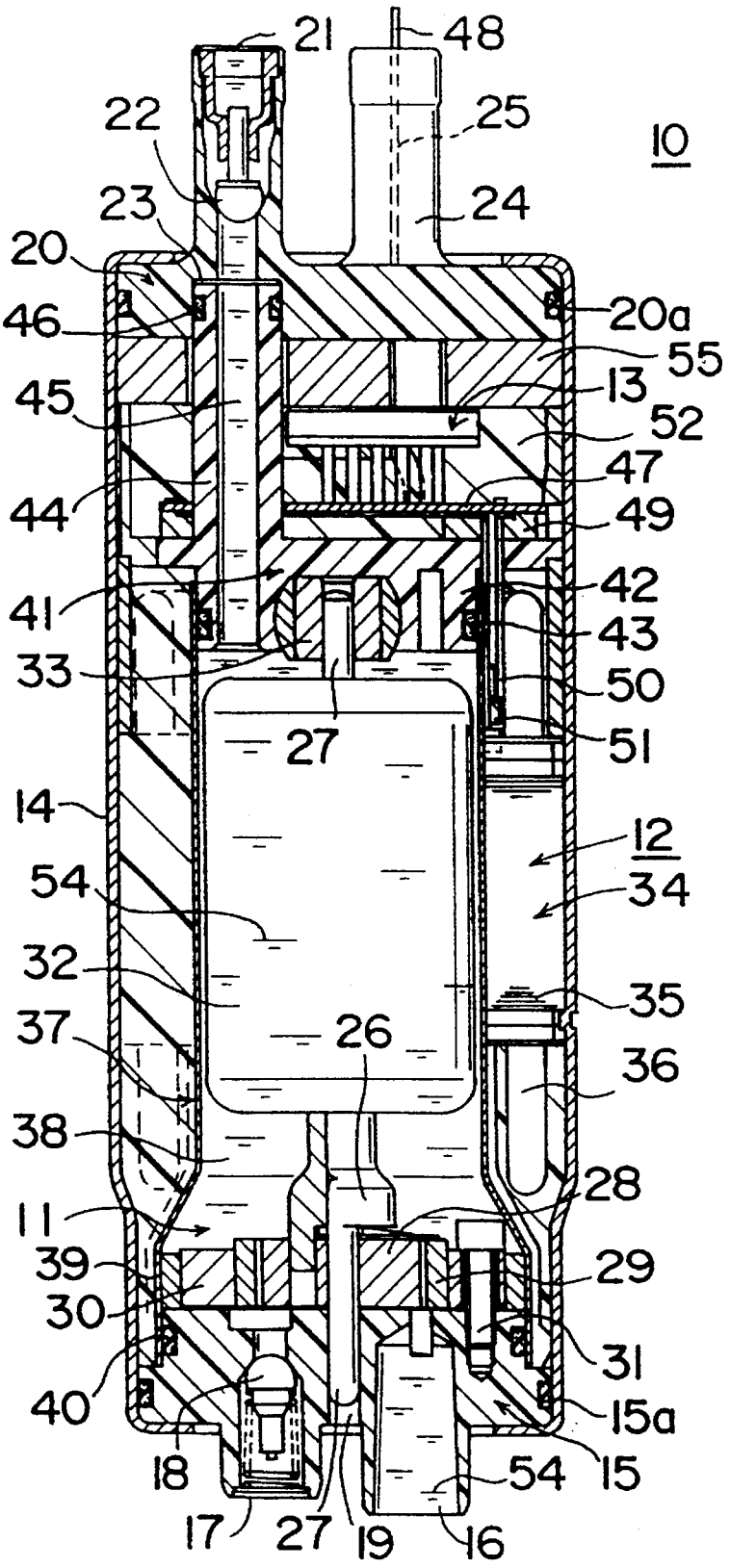
FIG. 1 is a front view showing a fuel feed pump for a vehicle in accordance with the embodiment of the present invention.

In this embodiment, a fuel feed pump 10 in accordance with the present invention is constructed as a fuel feed pump for a vehicle. The fuel feed pump 10 comprises: a pump 11; a brushless motor 12 for driving the pump 11; and a control circuit unit 13 for controlling the brushless motor 12, in which a control circuit is unitarily provided. These elements 11, 12, 13 are unitarily stored in an outer cylinder (housing) 14.

The outer cylinder 14 is generally formed into a cylindrical shape, and an inlet cover 15 and an outlet cover 20 are respectively fitted in the opening portions thereof, and are fixed by a curling. A seal ring 15*a* is put between the inlet cover 15 and the outer cylinder 14, in a sealing state. A seal ring 20*a* is put between the outlet cover 20 and the outer cylinder 14, in a sealing state. An introductory duct 16 for introducing a fuel into the fuel feed pump 10; a relief port 17 for discharging excess fuel timely; and a axial opening 19 for supporting a rotor axis described hereinafter; are opened at the inlet cover 15. The relief port 17 is provided with a relief valve 18 so as to only admit a current from the inside of the fuel feed pump 10 to the outside thereof.

A delivery duct 21 is opened at the outlet cover 20 for delivering a fuel, a check valve 22 is provided thereto so as to admit from the inside of the fuel feed pump 10 to the outside thereof. The delivery duct 21 is suitably connected to a fuel injector of a vehicle. A supporting hole 23 is provided on the inside of the outlet cover 20, coaxially to the delivery duct 21. Further, lead wire holding portions 24 are arranged on the position of the outlet cover 20 away from the delivery duct 21, which are formed so as to protrude toward the outside. Each lead wire holding portion 24 is respectively provided with a lead wire passing hole 25 coaxially, and is respectively connected to a lead wire 48.

The pump 11 is arranged at the side of the inlet cover 15 of the outer cylinder 14, adjacent to the inlet cover 15. The pump 11 is provided with a Gerotor inner 28, a Gerotor outer 29, a cam ring 30 and the like. The cam ring 30 is fixed to the inlet cover 15 by a bolt 31. The Gerotor inner 28 is passed through a rotor axis 27 of the brushless motor 12. The rotor axis 27 is fitted into the axial opening 19 of the inlet cover 15, so that the rotor axis 27 is rotatably supported. A drive dock 26 is inserted in the Gerotor inner 28, which rotates with the unitary rotor axis 27, so that the torque is transmitted to the Gerotor inner 28 by a drive dock 26.

The brushless motor 12 is generally arranged on the center portion of the inside of the outer cylinder 14. The brushless motor 12 is provided with a rotor 32, a stator 34 and the control circuit unit 13. A plurality of magnets is arranged on the outer circumference of the axial center portion of the rotor axis 27 at regular intervals, and is fixed by a covering of resin. The rotor 32 is axially erected between the inlet cover 15 and a holder plate 41. One end portion of the rotor axis 27 is rotatably supported on the axial opening 19 of the inlet cover 15, the other end portion is rotatably supported on a bearing 33 which is held by the holder plate 41.

On the other hand, the stator 34 is provided with a plurality of cores 35 and coils 36 which are wound around each core 35. Each core 35 is arranged on the inner face of the outer cylinder 14 with equally spacing in the circumferential direction, and is fixed. Each coil 36 is electrically connected to the control circuit of the control circuit unit 13, which is constructed so as to form a rotating magnetic field.

In this embodiment, an inner cylinder 37 is generally formed into a cylindrical shape, which is coaxially arranged so as to separate the rotor 32 and the stator 34. That is to say, the rotor 32 is in the state to be stored in the inner cylinder 37, the stator 34 is in the state to be arranged at the outside of the inner cylinder 37. A fuel duct 38 is constructed in the space of the inner cylinder. A large diameter portion 39, the diameter of which is enlarged, is formed at the end portion of the side of the inlet cover 15 of the inner cylinder 37. The large diameter portion 39 is fitted to the outer circumference of the inlet cover 15 in a state to cover the outside of the pump 11. A seal ring 40 is put between the inner cylinder 37 and the inlet cover 15.

A male centering location 42 is protrudely provided in the holder plate 41, which is inserted in the other end portion of the inner cylinder 37, a seal ring 43 is put between the inner cylinder 37 and the male centering location 42 in a sealing state. The bearing 33 is held at the holder plate 41, one end portion of the rotor axis 27 is rotatably supported by the bearing 33. A contacting pipe 44 is arranged at the position close to the outside of the holder plate 41, which is provided toward the outward of the axial direction thereof. The contacting pipe 44 is fitted into the supporting hole 23 of the outlet cover 20. A seal ring 46 is put between the contacting pipe 44 and the supporting hole 23 in a sealing state. The connecting duct 45 connected between the fuel duct 38 of the inner cylinder 37 and the delivery duct 21 of the outlet cover 20 is substantially formed by a space of the contacting pipe 44.

The control circuit unit 13 is arranged at the side of the outer end face of the holder plate 41. A printed wiring board 47 is a part of the control circuit unit 13, which is held stationary on the outer end face of the holder plate 41. Two lead wires 48 are respectively drawn into the control circuit unit 13 by passing through the lead wire passing hole 25 of the outlet cover 20, and is electrically connected to the control circuit in the control circuit unit 13. A plate 55 for radiating is also provided to the control circuit unit 13 so as to be able to radiate the exothermicity thereof. Further, a sensor holder 49 is a part of the control circuit unit 13, which is held by the holder plate 41. A lead wire 50 is held at the sensor holder 49, which is mechanically and electrically connected to a sensor 51 for detecting the rotation of the rotor 32. The sensor 51 is connected to the end of the lead wire 50, which is arranged so as to be able to detect the rotation of the rotor 32 on the outside of inner cylinder 37.

In this embodiment, a resin sealed portion 52 is formed between the inner cylinder 37 and the outer cylinder 14, and is formed at the circumference of the holder plate 41, by a potting method. The part of the resin sealed portion 52, is formed at the circumference of the holder plate 41, is in the state to seal the whole of control circuit unit 13 which is held on the outer face of the holder plate 41. A material having thermal conductivity is used as potting resin for forming the resin sealed portion 52.

Next, a manufacturing method of the fuel feed pump 10 in accordance with the above construction is described.

Figure 2:
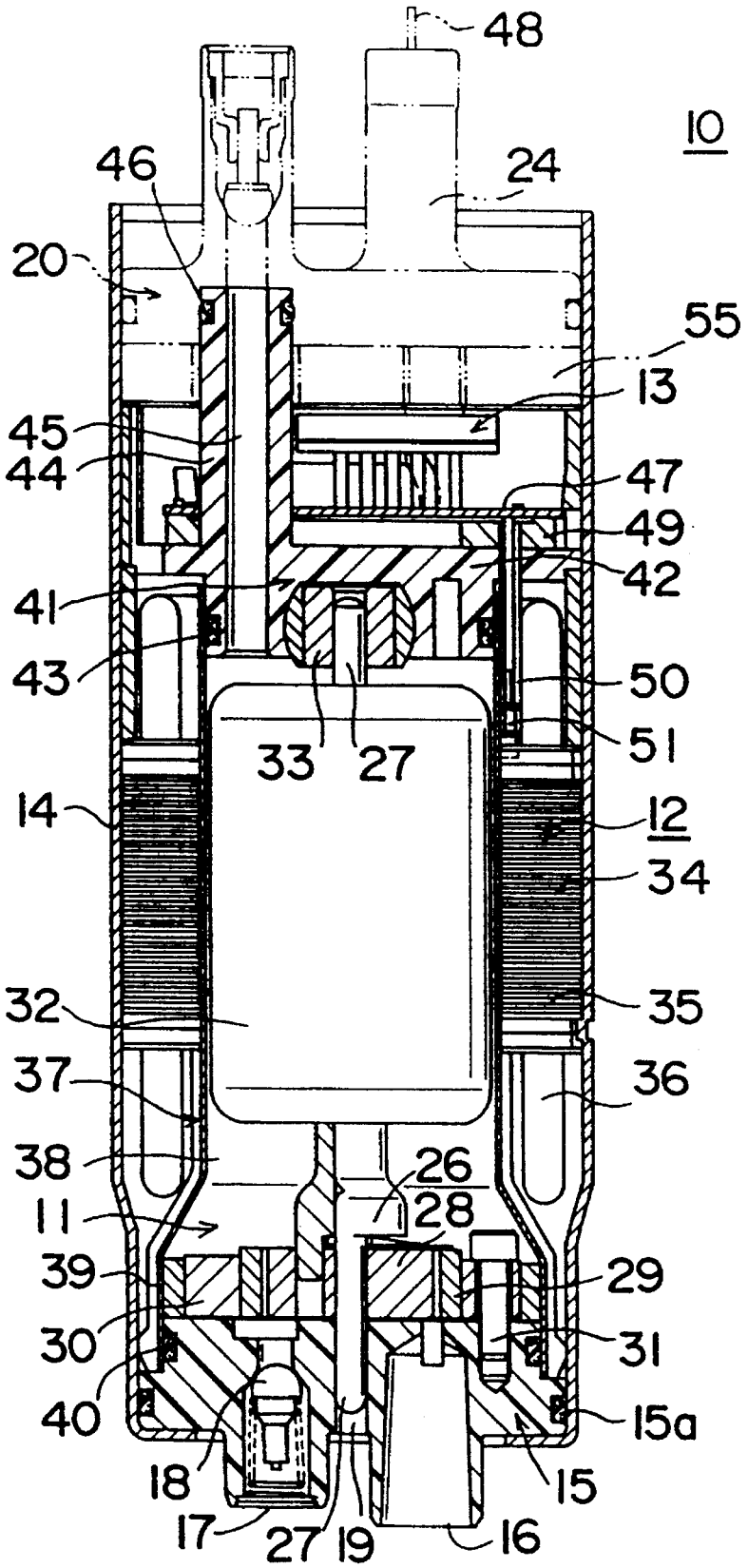
FIG. 2 is a front sectional view showing one assembling step of parts.

First, as shown in FIG. 2, in the state in which one end portion of the side of the outlet cover 20 of the outer cylinder 14 is opened, the inlet cover 15, the brushless motor 12 are inserted in turn, in the outer cylinder 14 from the opening thereof. When inserting, the large diameter portion 39 is fitted on the inlet cover 15, and the inner cylinder 37 is provided between the rotor 32 and the stator 34 of the brushless motor 12.

Successively, the holder plate 41 is inserted in the outer cylinder 14 from the opening of the side of the outlet cover 20 thereof, the male centering location 42 is fitted into the opening of the side of the outlet cover 20 of the inner cylinder 37. By this fitting, the opening of the side of the outlet cover 20 of the inner cylinder 37 is blockaded, so that the fuel duct 38 of the inner cylinder 37 is in a blocking state. When the male centering location 42 of the holder plate 41 is fitted into the inner cylinder 37, one end portion of the rotor axis 27 is fitted into the bearing 33. In advance, the control circuit unit 13 is assembled in the holder plate 41.

Figure 3:
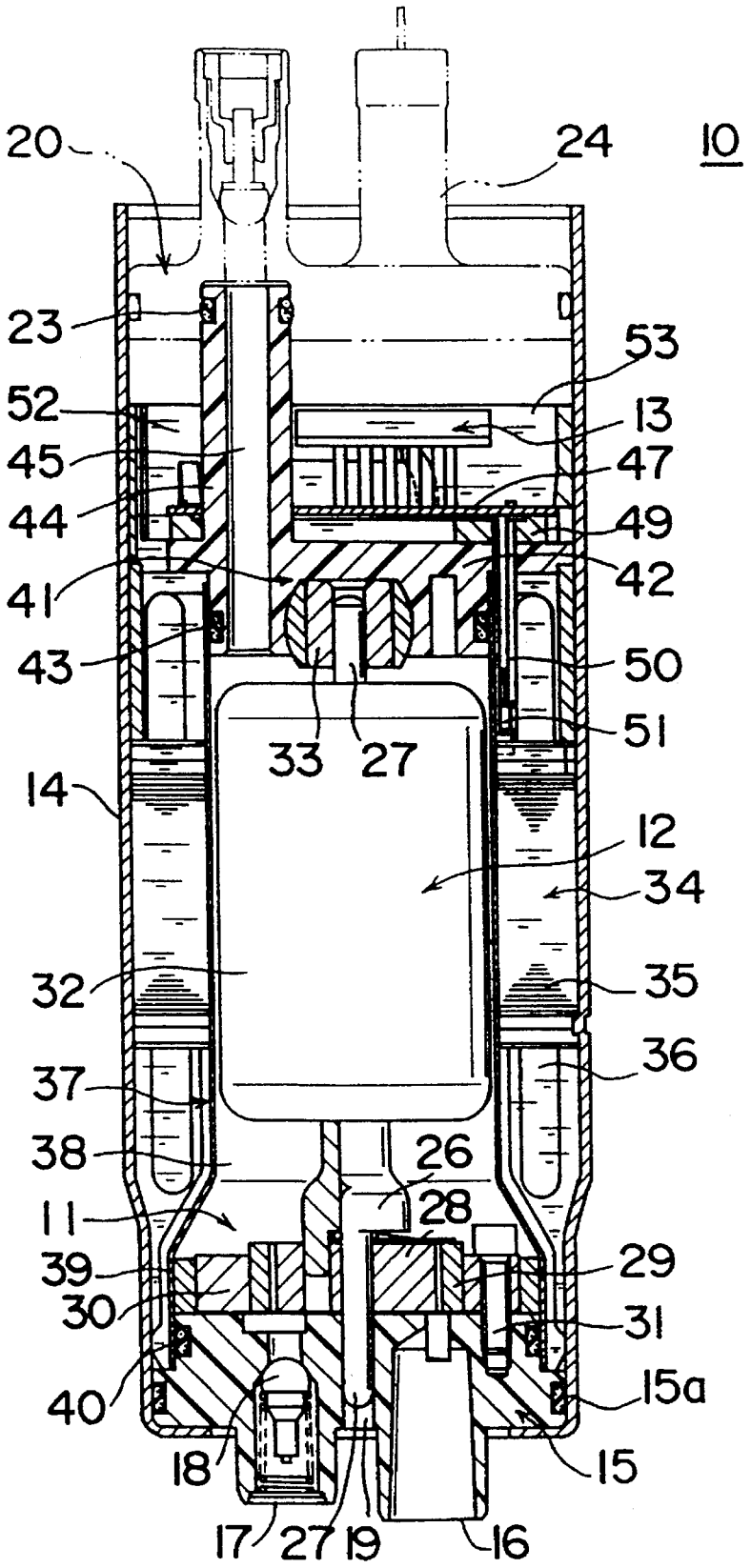
FIG. 3 is a front sectional view showing a potting step.

After that, as shown in FIG. 3, a potting resin 53 which is in a liquid state, is potted in the outer cylinder 14 from the opening of the side of the of the outlet cover 20. The potting resin 53 in a liquid state penetrates every nook and corner between the outer cylinder 14 and the inner cylinder 37. After interring the space, the circumferential space of the holder plate 41 in the outer cylinder 14 is interred, so that the control circuit unit 13 is in the resin sealed state. When the control circuit unit 13 is sealed by resin, the potting resin 53 in a liquid state penetrates every nook and corner of the control circuit unit 13.

When enforcing a potting method, a forming pressure is not added as when enforcing a molding method, so that it is unnecessary to construct the control circuit unit 13 to a pressure-withstanding structure. That is, it is possible to omit the storing of the control circuit unit 13 in a sealed casing. Further, thermoplastic resin can be used as the potting resin 53, so that it is possible to easily avoid exceeding the heat-proof temperature of the control circuit unit 13. Even in the case of being able to be used, the heat-crosslinking-temperature can be restrained, so that it is possible to sufficiently satisfy the restriction of the heat-proofing of the control circuit unit 13. Furthermore, a material having good thermal conductivity can be selected as the potting resin 53, so that it is possible to radiate the exothermicity of the control circuit unit 13.

When the potting resin 53 hardens, the resin sealed portion 52 is in the state be formed between the outer cylinder 14 and the inner cylinder 37. After or before the potting resin 53 hardens, the plate 55 and the outlet cover 20 is inserted in the opening of the outer cylinder 14, so that the opening of the outer cylinder 14 is blockaded. Continuously, one end portion of the outer cylinder 14 is rolling caulked toward the inside of the diameter direction, the outlet cover 20 is connected to the outer cylinder 14. By this connection, the inlet cover 15, the pump 11, the brushless motor 12, the holder plate 41, the control circuit unit 13 and the outlet cover 20 stored in the outer cylinder 14 are unitarily fixed.

Next, the operation is described.

The lead wires 48 are connected to a power supply, when the electricity is supplied therefrom to the control circuit unit 13 through the lead wires 48, the coil 36 of the stator 34 in the brushless motor 12 forms a rolling magnetic field by the control of the control circuit. By this rolling magnetic field, the rotor 32 in the brushless motor 12 rotates.

When the rotor 32 of the brushless motor 12 rotates, the Gerotor inner 28 in the pump 11 is rotated by the drive dock 26. By this rotation, the pump 11 absorbs a fuel 54 from the introductory duct 16, and the fuel 54 is increased in pressure. The fuel 54 increased in pressure by the pump 11 discharges in the fuel duct 38 which is formed by the space of the inner cylinder 37.

When the fuel 54 in the fuel duct 38 is contacting on the side wall of the inner cylinder 37 and the rotor 32, the fuel 54 reaches to the contacting duct 45 which is opened at the opposite side of the inner cylinder 37. When the fuel 54 flows in the fuel duct 38, the seal ring 40 is put between the inner cylinder 37 and the inlet cover 15, the seal ring 43 is put between the inner cylinder 37 and the male centering location 42, so that it is possible to prevent leaking of the fuel 54 to the outside of the fuel duct 38.

The fuel 54 in the contacting duct 45 reaches to the delivery duct 21 which is connected thereto, and is delivered from the delivery duct 21 to a fuel injector which is connected to the fuel feed pump 10. When the fuel 54 flows in the contacting duct 45: the seal ring 43 is put between the inner cylinder 37 and the male centering location 42, and the seal ring 46 is put between the contacting pipe 44 and the supporting hole 23 of the outlet cover 20; so that it is possible to prevent the leak of the fuel 54 to the outside of the fuel duct 38. Thus, it is possible to prevent the corrosion of the resin sealed portion 52, the stator 34 of the brushless motor 12 and the control circuit unit 13 by leaked fuel 54.

The present invention is not limited to this embodiment; in so far as the essence of the invention is not deviated from, it goes without saying that the present invention can be modified.

For instance, it is also possible to employ a vane pump, turbine pump and the like instead of a Gerotor pump.

What is claimed is:

1. A fuel feed pump wherein a housing, a pump in a housing, a brushless motor for driving the pump, a control circuit unit for controlling the brushless motor are assembled, a fuel duct is formed on the inside of the housing, a fuel is lead from an introductory duct which is opened at one end portion of the housing to the fuel duct, and is delivered from a delivery duct which is opened at the other end portion of the housing;

the fuel feed pump comprising:

an inner cylinder, which is provided between a stator and the rotor of the brushless motor, the fuel duct is formed by a space therein;

a holder plate, which is provided at one end portion of the inner cylinder, which is blockaded thereby and the control circuit unit is held thereon;

a contacting pipe for a constructing duct, which is provided at the holder plate, the fuel duct of the inner cylinder and the delivery duct are connected to each other by the constructing duct;

a resin sealed portion, which is formed in an outside space of the inner cylinder and the circumference of the control circuit unit in the housing by a potting resin.

2. The fuel feed pump in accordance with claim 1, further comprising:

a plate which is provided close to the control circuit unit and the contacting pipe in the housing;

whereby the heat of the control circuit unit is radiated through the plate, the contacting pipe and the fuel in the contacting duct.

3. The fuel feed pump in accordance with claim 2, wherein:

the plate which is generally formed into a disc shape, a diameter of which is smaller than an inside diameter of the housing, which has a hole for passing through the contacting pipe; and provided in the housing coaxially therewith, one face of which is faced toward an upper face of the control circuit unit and the hole is passed through by the contacting pipe.

4. The fuel feed pump in accordance with claim 1, further comprising:

an inlet cover which is provided at the one end portion of the housing.

5. The fuel feed pump in accordance with claim 4, wherein:

a seal member which is provided between an inside wall of the inner cylinder and an outside wall of the inlet cover.

6. The fuel feed pump in accordance with claim 4, wherein:

a seal member which is provided between an inside wall of the housing and an outside wall of the inlet cover.

7. The fuel feed pump in accordance with claim 4, wherein:

an introductory duct which is provided at the inlet cover.

8. The fuel feed pump in accordance with claim 4, wherein:

a relief port which is provided at the introductory duct.

9. The fuel feed pump in accordance with claim 8, wherein:

a relief valve which is provided in the relief port.

10. The fuel feed pump in accordance with claim 1, wherein:

an outlet cover which is provided at the other end portion of the housing.

11. The fuel feed pump in accordance with claim 10, wherein:

a delivery duct which is provided at the outlet cover.

12. The fuel feed pump in accordance with claim 11, wherein:

a check valve which is provided at the delivery duct.

13. The fuel feed pump in accordance with claim 10, wherein:

a hole for inserting the contacting pipe therein, which is provided at the face of the outlet cover, the face is facing toward the inside of the housing.

14. The fuel feed pump in accordance with claim 13, wherein:

the contacting pipe is inserted in the hole;

a seal member which is provided between a side wall of the hole and an outside wall of the contacting pipe, which is a part inset in the hole.

15. The fuel feed pump in accordance with claim 1, wherein:

a seal member which is provided between the inside wall of the housing and the outside wall of the outlet cover.

16. The fuel feed pump in accordance with claim 1, wherein:

a male centering location which is provided at the holder plate.

17. The fuel feed pump in accordance with claim 16, wherein:

a seal member which is provided between the inside wall of the inner cylinder and the outside wall of the male centering location.

18. The fuel feed pump in accordance with claim 1, wherein:

a diameter of the other end portion of an inner cylinder is enlarged.

19. The fuel feed pump in accordance with claim 1, wherein:

the pump is a Gerotor pump.

* * * * *